US011135869B1

(12) United States Patent
Lundelius

(10) Patent No.: US 11,135,869 B1
(45) Date of Patent: Oct. 5, 2021

(54) RECREATION SUPPLIES CONTAINER

(71) Applicant: William Lundelius, Phelan, CA (US)

(72) Inventor: William Lundelius, Phelan, CA (US)

( * ) Notice: Subject to any disclaimer, the term of this patent is extended or adjusted under 35 U.S.C. 154(b) by 346 days.

(21) Appl. No.: 16/252,800

(22) Filed: Jan. 21, 2019

(51) Int. Cl.

| | |
|---|---|
| ***B65D 3/04*** | (2006.01) |
| ***B44D 3/04*** | (2006.01) |
| ***B44D 3/12*** | (2006.01) |
| ***B44D 3/18*** | (2006.01) |

(52) U.S. Cl.
CPC ..... *B44D 3/04* (2013.01); *B44D 3/125* (2013.01); *B44D 3/18* (2013.01)

(58) Field of Classification Search
CPC ..... B44D 3/04; B44D 3/125; B44D 3/18
USPC ... 206/1.7, 1.8, 1.9, 214, 224, 371, 765, 758
See application file for complete search history.

(56) References Cited

U.S. PATENT DOCUMENTS

| | | | | |
|---|---|---|---|---|
| 3,777,418 | A * | 12/1973 | Cooper | A45C 13/08 434/425 |
| 4,129,213 | A | 12/1978 | Fleig | |
| 4,807,538 | A * | 2/1989 | Hoffman | A63H 33/00 108/25 |
| 5,014,850 | A | 5/1991 | Huff | |
| 5,134,918 | A * | 8/1992 | Chang | A45C 11/34 206/214 |
| D355,217 | S * | 2/1995 | Luna | D19/78 |
| D394,879 | S * | 6/1998 | Carbonaro | D19/78 |
| 6,619,474 | B2 * | 9/2003 | Montgomery | B44D 3/02 206/1.5 |
| 7,591,382 | B2 * | 9/2009 | Brock | A45D 33/26 211/10 |
| 2008/0156667 | A1 * | 7/2008 | Huggins | B44D 3/04 206/1.8 |

* cited by examiner

*Primary Examiner* — Luan K Bui
(74) *Attorney, Agent, or Firm* — Sanchelima & Associates PA; Christian Sanchelima; Jesus Sanchelima

(57) ABSTRACT

The present invention relates to a recreation supplies container. The container comprises a body having a substantially triangular cross section defined by a first surface, a second surface, an inclined surface, a first flat surface adjoining operative top ends of the first surface and the inclined surface, and a second flat surface adjoining an operative bottom end of the inclined surface and a free end of the second surface; a first plurality of cavities is configured on the inclined surface, wherein the first plurality of cavities have a rectangular configuration; a second plurality of cavities is configured on the first flat surface, wherein the second plurality of cavities have a circular cross section; a working platform provided within the second flat surface, wherein the working platform is drawn out in an operational configuration thereof; a storage space defined by the surfaces of the body.

8 Claims, 4 Drawing Sheets

RECREATION SUPPLIES CONTAINER

BACKGROUND OF THE INVENTION

1. Field of the Invention

The present disclosure relates to the field of storage boxes. In particular, the present disclosure relates to a recreation supplies container, which can be used to store the recreation or hobby supplies as well as provide easy access to the supplies while the user is engaged in the recreational activity.

2. Description of the Related Art

Storage boxes are known in the art. Some examples of storage boxes include makeup boxes, jewelry boxes, toolboxes, and the like. An advantageous feature of the storage box is that the storage box should allow a user to readily access the item being stored within the box. Hobbyists like artists or crafters often find it difficult to access their supplies readily while working, which is not desired. As such, there is felt a need of a storage box for storage of recreation supplies that can store the supplies, while at the same time provide ease of access to the users at the time when the users are pursuing their hobby.

Several designs for storage containers have been designed in the past. None of them, however, are known to be specifically designed for storage of recreation supplies, while at the same time provide ease of access to the users at the time when the users are pursuing their hobby.

Applicant believes that a related reference corresponds to U.S. Pat. No. 4,129,213 filed by WILLIAM C. FLEIG. The Fleig reference discloses a portable case-like unit useful in the practice of crafts and hobbies, wherein the unit comprises a base containing a working surface and storage compartments and a cover to enclose said working surface and storage compartments. However, the unit disclosed in the Fleig reference fails to disclose any feature for providing storage of recreation supplies, while at the same time provide ease of access to the users at the time when the users are pursuing their hobby.

Applicant believes that a related reference corresponds to U.S. Pat. No. 5,014,850 filed by PHYLLIS M. HUFF. The Huff reference discloses a utility storage box particularly useful for storage items such as drawing instruments and school supplies. However, the unit disclosed in the Huff reference fails to disclose any feature for providing storage of recreation supplies, while at the same time provide ease of access to the users at the time when the users are pursuing their hobby.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a recreation supplies container having a multiplicity of compartments for storing the recreation supplies.

It is yet another object of the present invention to provide a recreation supplies container having a multiplicity of compartments for storing the recreation supplies, while at the same time provide ease of access to the users at the time when the users are pursuing their hobby.

Further objects of the invention will be brought out in the following part of the specification, wherein detailed description is for the purpose of fully disclosing the invention without placing any limitations thereon.

BRIEF DESCRIPTION OF THE DRAWING

With the above and other related objects in view, the invention consists in the details of construction and combination of parts as will be more fully understood from the following description, when read in conjunction with the accompanying drawings in which:

FIG. 3 illustrates another perspective view of a recreation supplies container 10, in accordance with an embodiment of the present invention, wherein a door 30 of the container 10 is latched on.

DETAILED DESCRIPTION OF THE EMBODIMENTS OF THE INVENTION

Figure 1:
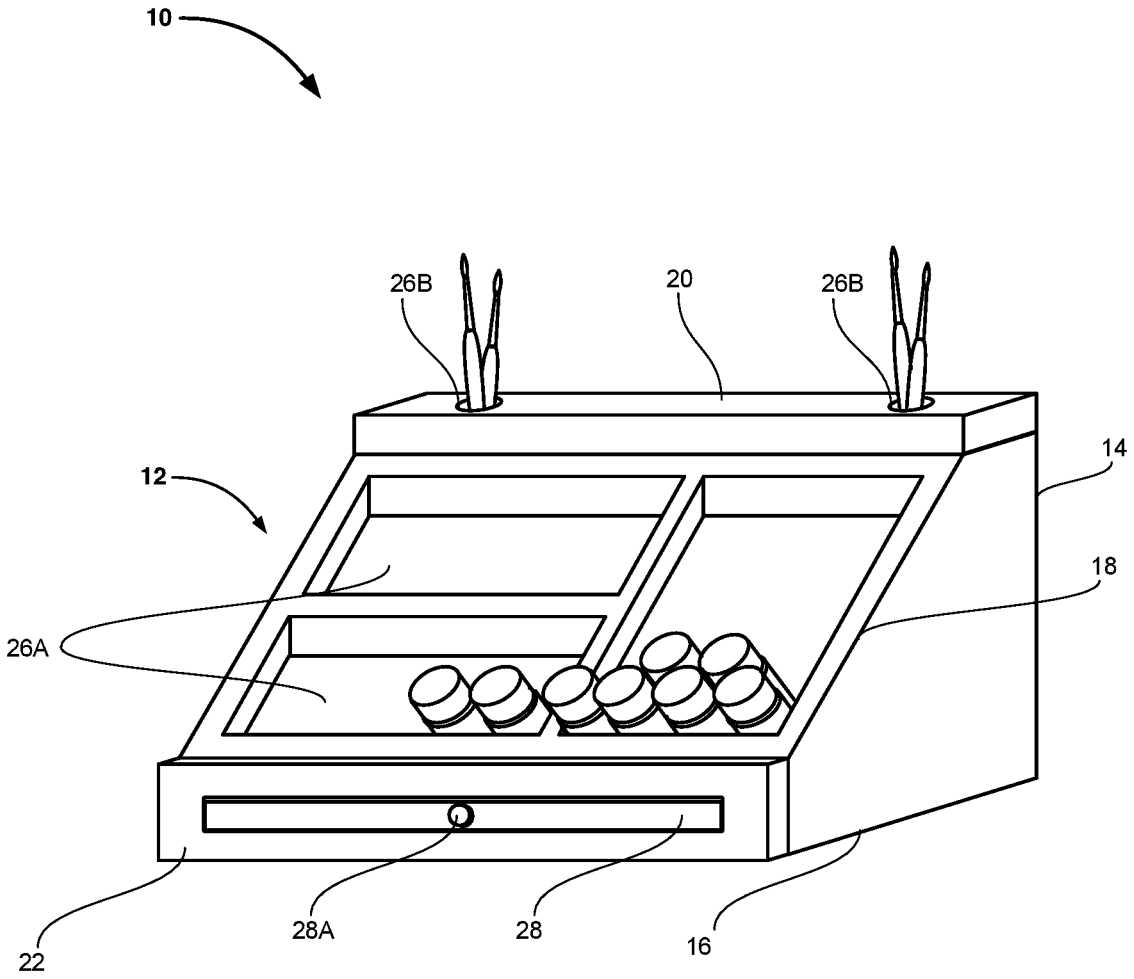
FIG. 1 illustrates a perspective view of a recreation supplies container 10, in accordance with an embodiment of the present invention, which comprises a body 12 having a first surface 14, a second surface 16, an inclined surface 18, a first flat surface 20 adjoining operative top ends of the first surface 14 and the inclined surface 18, and a second flat surface 22 adjoining an operative bottom end of the inclined surface 18 and a free end of the second surface 16.

Referring now to FIG. 1 thru FIG. 4, where the present invention is generally referred to with numeral 10, it can be observed that a recreation supplies container 10 (hereinafter referred to as container 10), in accordance with an embodiment of the present invention, comprises a body 12 having a first surface 14, a second surface 16, an inclined surface 18, a first flat surface 20 adjoining operative top ends of the first surface 14 and the inclined surface 18, and a second flat surface 22 adjoining an operative bottom end of the inclined surface 18 and a free end of the second surface 16.

The body 12 has a substantially triangular configuration. More specifically, the body 12 has a cross section that closely resembles a right angled triangle. However, the presence of presence of the first flat surface 20 and the second flat surface 22 gives the body 12 a trapezoidal configuration.

Figure 4:
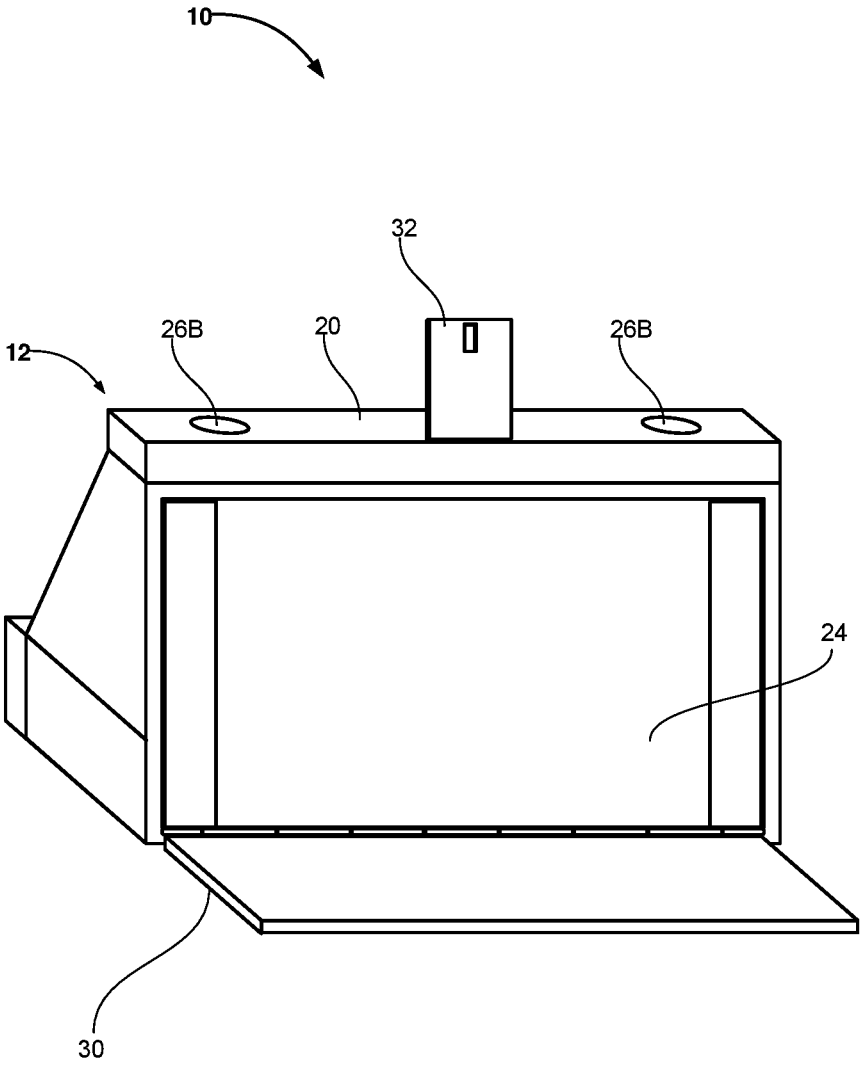
FIG. 4 illustrates another perspective view of a recreation supplies container 10, in accordance with an embodiment of the present invention, wherein a door 30 of the container 10 is open, thereby providing access to a storage space 24.

The body 12 is a hollow body that is defined by the first surface 14, the second surface 16, the inclined surface 18, the first flat surface 20 adjoining operative top ends of the first surface 14 and the inclined surface 18, and the second flat surface 22 adjoining an operative bottom end of the inclined surface 18 and a free end of the second surface 16. As such, the body 12 defines a storage space 24 that is configured by the aforementioned surfaces of the body 12. The storage space 24 can be used to store various recreation or hobby supplies such as paints, brushes, rags, thinner, gum, and other such items. The container 10 further comprises a door 30 that provides the access to the storage space 24. The door 30 can be locked by means of a latch 32, as seen in FIG. 4.

Every hobby or a recreational activity has some items associated with them that allow the person to pursue that particular hobby or recreational activity. The container 10 is configured to store most of these items. For example, a person who enjoys cooking has some dedicated cooking utensils/tools, which can also be stored in the container 10.

The container 10 further comprises a plurality of cavities 26A, 26B. The first plurality of cavities 26A are configured on the inclined surface 18. The purpose of the first plurality of cavities 26A is to hold the recreational items or hobby items securely therewithin. As seen in FIG. 1, the cavities 26A are used to hold paint bottles. Similarly, other such items can also be held within the cavities 26A. The number of cavities 26A can be configured per the application requirements. In the present embodiment, the cavities 26A have a rectangular configuration. However, cavities 26A can also have other configurations, per the application requirements.

The second plurality of cavities 26B is configured on the first flat surface 20. The second plurality of cavities 26B also carry the same function as the first plurality of cavities 26A, i.e., to hold the hobby items therewithin. However, the second plurality of cavities 26B have a vertically elongate configuration for holding items such as pen, pencil, paintbrush, and the like. In the present embodiment, the cavities 26B have a circular cross section. However, the cavities 26B can have any shape and are not limited to have the circular cross section. Also, any number of cavities 26B can be configured per the application requirements.

Figure 2:
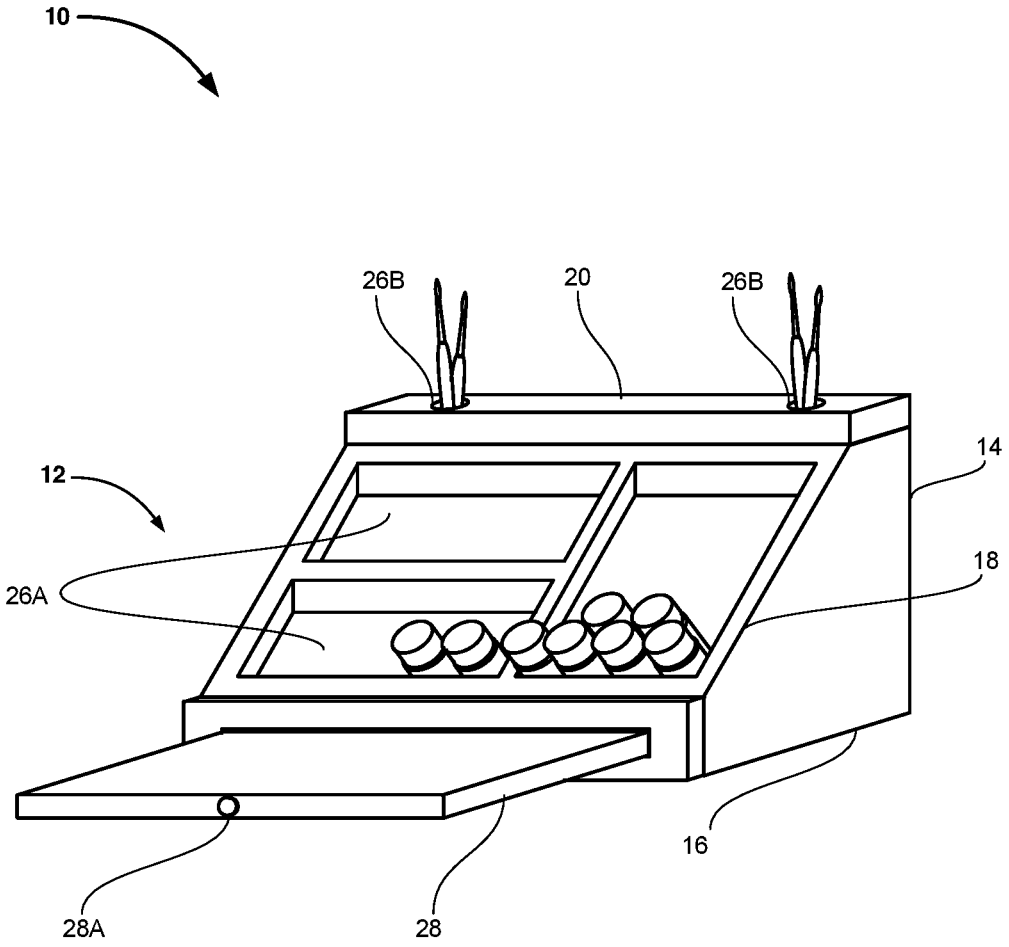
FIG. 2 illustrates another perspective view of a recreation supplies container 10, in accordance with an embodiment of the present invention, wherein a working platform 28 of the recreation supplies container 10 is drawn out in its operational state.
Figure 3:
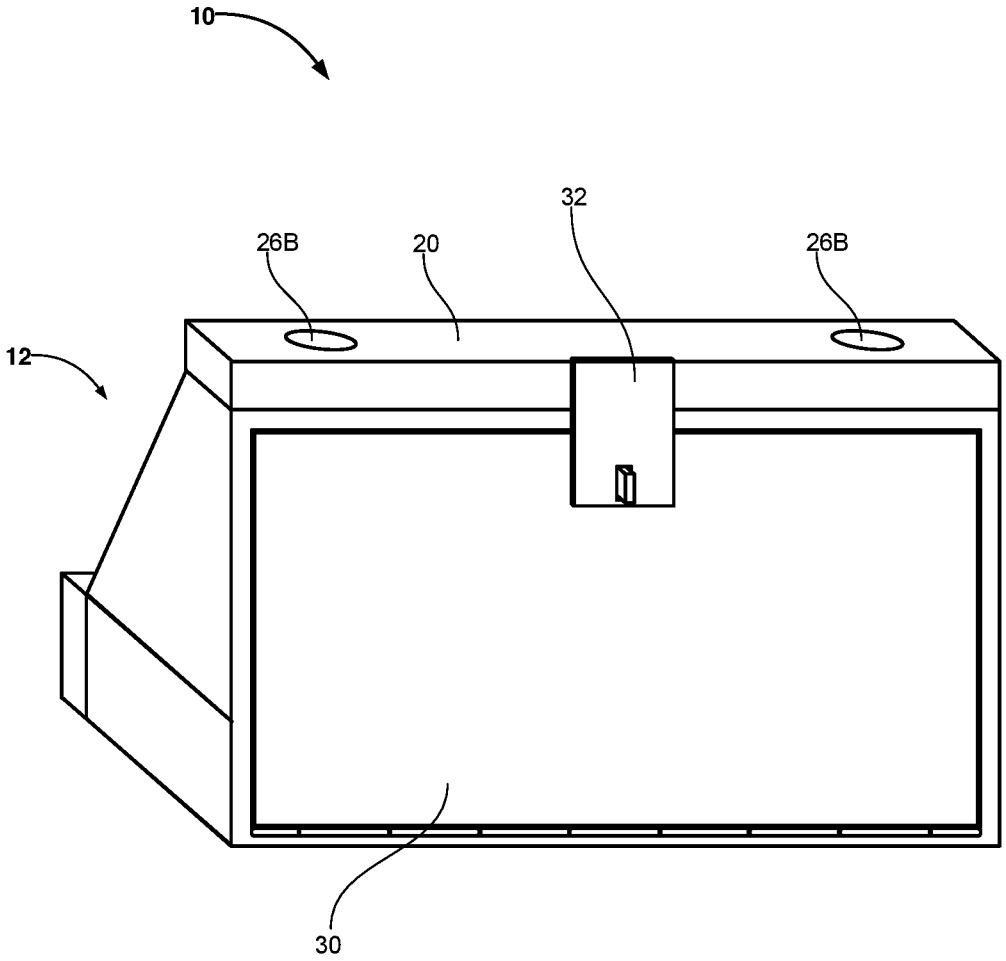

The container 10 further comprises a working platform 28. The working platform 28 has a drawer like configuration. The working platform 28, in its inoperational state, is housed within the body 10 at the second flat surface 22. As seen in FIG. 2, the working platform 28 can be drawn out for use via the knob 28A. The user can use the working platform 28 as per the requirements.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A recreation supplies container comprising:

a. a body having a substantially triangular cross section defined by a first surface, a second surface, an inclined surface, a first flat surface adjoining operative top ends of the first surface and the inclined surface, and a second flat surface adjoining an operative bottom end of the inclined surface and a free end of the second surface;

b. a first plurality of cavities is configured on the inclined surface, wherein the first plurality of cavities have a rectangular configuration;

c. a second plurality of cavities is configured on the first flat surface, wherein the second plurality of cavities have a circular cross section d. a working platform provided within the second flat surface, wherein the working platform is drawn out in an operational configuration thereof;

e. a storage space defined by the surfaces of the body;

f. a door configured on the first surface, the door configured to provide access to the storage space; and g. a latch for locking the door to secure the storage space.

2. The container according to claim 1 wherein said working platform has a rectangular shape.

3. The container according to claim 1 wherein said working platform includes a knob to facilitate opening and storing the working platform within the body.

4. The container according to claim 1 wherein said second plurality of cavities include two cavities.

5. The container according to claim 1 wherein said second plurality of cavities include openings located entirely above the first plurality of cavities.

6. The container according to claim 1 wherein said door includes a hinge along bottom edge.

7. The container according to claim 1 wherein said first plurality of cavities includes three cavities.

8. The container according to claim 1 wherein said latch includes a flat rectangular member.

* * * * *